United States Patent [19]

Nagy

[11] Patent Number: 4,496,065

[45] Date of Patent: Jan. 29, 1985

[54] KEY OPERATED SECURITY CAP

[76] Inventor: David L. Nagy, 5114 N. Western Ave., Chicago, Ill. 60625

[21] Appl. No.: 570,453

[22] Filed: Jan. 13, 1984

[51] Int. Cl.[3] ..... B65D 51/16

[52] U.S. Cl. ..... 215/207; 215/215; 215/296

[58] Field of Search ..... 215/207, 215, 296, 302; 220/284

[56] References Cited

U.S. PATENT DOCUMENTS

| | | | |
|---|---|---|---|
| 3,744,654 | 7/1973 | Bromberg | 215/215 |
| 4,056,209 | 11/1977 | Winkler et al. | 215/215 |
| 4,098,417 | 7/1978 | Bennett | 215/207 |
| 4,172,532 | 10/1979 | Palsson | 215/296 |

FOREIGN PATENT DOCUMENTS

| | | | |
|---|---|---|---|
| 223931 | 1/1958 | Australia | 215/207 |

*Primary Examiner*—George T. Hall

*Attorney, Agent, or Firm*—Harvey B. Jacobson

[57] ABSTRACT

A key operated security cap structure for a container, such as a medicine bottle, having a neck defining an opening for the container comprises a cap member for fitting over the neck of the container in a manner precluding removal of the cap member during normal usage of the container, the cap member having an internally threaded cylindrical portion extending above the rim of the container, a cylindrical externally threaded plug for threading into the cap member to a terminal position wherein the outer surface of the plug is substantially flush with the rim of the cap member, the outer surface of the plug being formed with a pair of diametrically spaced key-receiving recesses, and a key having a pair of projections fitting in the plug recesses to provide a means for removing the plug and opening the container.

13 Claims, 3 Drawing Figures

KEY OPERATED SECURITY CAP

BACKGROUND OF THE INVENTION

This invention relates to a key operated cap structure for use on containers, such as medicine bottles and the like, to prevent unauthorized access being obtained to the container, so that the container contents are available only to persons in possession of a suitable key.

It is of importance that containers such as medicine bottles and the like have security against unauthorized access, e.g. to prevent children from getting at the container contents. The need for security caps for such containers has long been recognized, and the art is replete with proposals of suitable security cap structures.

For example, the following U.S. patents disclose security closures and the like for containers.

U.S. Pat. No. 3,094,648
U.S. Pat. No. 3,396,864
U.S. Pat. No. 3,426,932
U.S. Pat. No. 3,485,402
U.S. Pat. No. 3,841,513
U.S. Pat. No. 3,893,581
U.S. Pat. No. 4,159,780

The prior art security cap structures tend to be of a complex construction, and certain of those which need keys to operate the cap, such as the structures shown in the Romaine and Kapphahn patents noted above, require the container or bottle neck to which the structure is applied to have a particular interior construction to enable the cap to be fitted.

It is an object of the present invention to provide a more simple form of key operated security cap structure which can be applied to a container without the container having to have a specialized internal construction.

SUMMARY OF THE INVENTION

The invention provides a security cap structure, particularly for medicine bottles and like containers, the cap structure comprising a cap member having a skirt portion for gripping around the neck of the container and a hollow cylindrical portion with an internal thread adapted to project above the rim of the container, a threaded plug for threading into the cylindrical portion of the cap member, the relative depths of the plug and cylindrical portion being such that the outer surface of the plug does not project substantially above the rim of the cylindrical portion when the plug is threaded into the cap member to a terminal position, at least one key-receiving depression formed in the outer surface of the plug, and a key having a projection related to the key-receiving depression in the plug, whereby the key may be used to thread the plug into and out of the cap member to open and close the container.

The cap member may be of metal or plastic and may be adhered or shrunk around the container neck without any internal modifications to the container being needed. Structures in accordance with the invention may be simply and economically manufactured and applied to a diversity of containers. The threaded plug may be readily applied and removed with a proper key, but offers good security against unauthorized access to the container for persons not having the requisite key.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
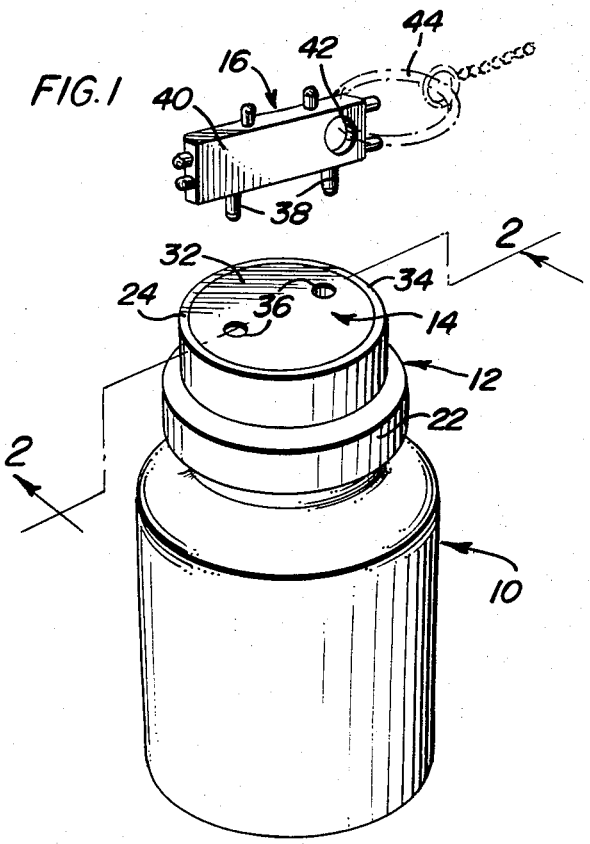
FIG. 1 is a perspective view of a medicine bottle fitted with a security cap structure in accordance with the invention.

Referring initially to FIG. 1 of the drawings, there is shown a medicine bottle 10 of known type, which may be a plastic molding, for example, the medicine bottle being fitted with a security cap structure comprising an outer cap member 12 secured around the neck of the bottle, a plug 14 which is threaded into the cap member, and a key 16 for unthreading the plug in order to obtain acccess to the bottle contents.

Figure 3:
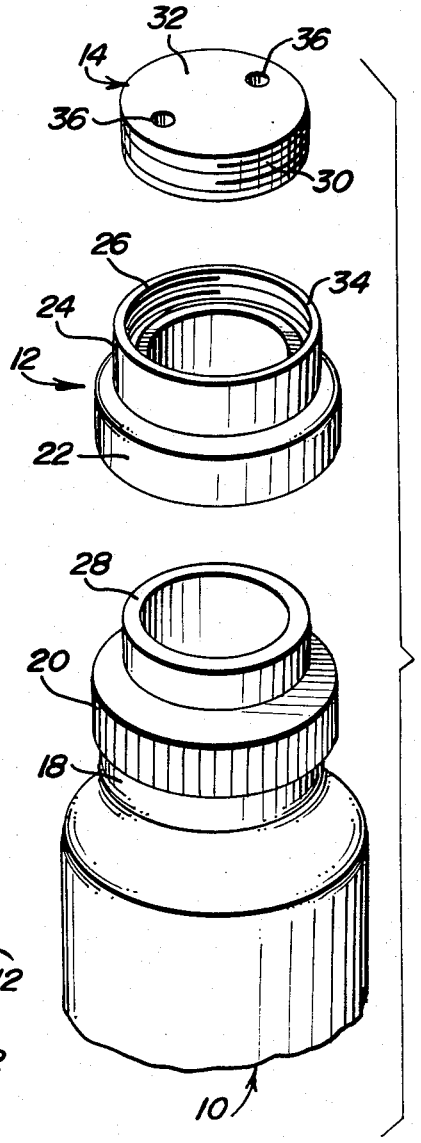
FIG. 3 is an exploded perspective view of parts of the bottle and cap structure.
Figure 2:
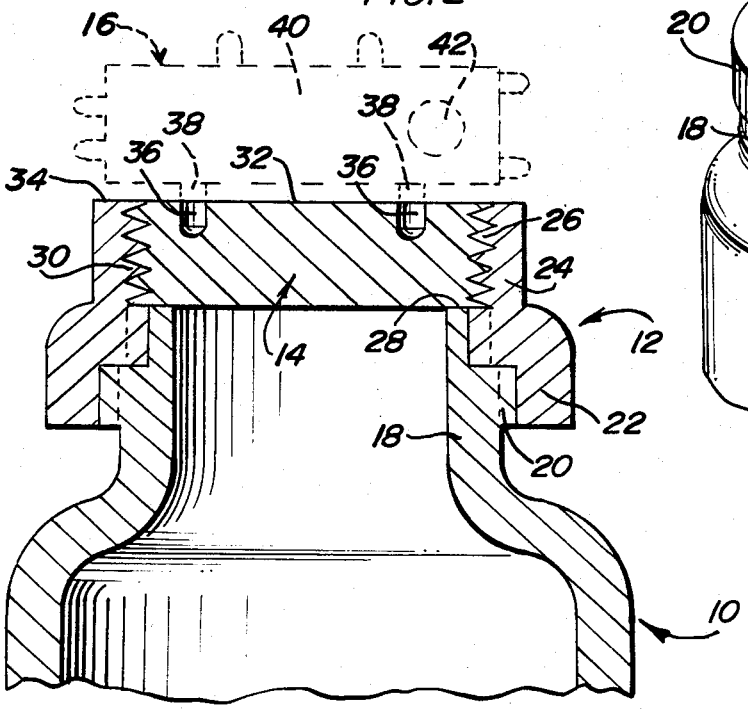
FIG. 2 is a sectional view on line 2—2 of FIG. 1.

The neck 18 of the medicine bottle may have an external circumferential flange 20 (see FIGS. 2 and 3) and the cap member (which may be made of plastic or metal) has a skirt portion 22 which grips the neck of the bottle over flange 20 in a manner precluding removal of the cap member from the container in normal usage. For example, the cap member may be adhered over the neck of the bottle or it may be shrunk around the neck. Upstanding from the skirt portion 22, the cap member includes a hollow cylindrical portion 24 with an internal thread 26, the portion 24 projecting above the rim 28 of the bottle which forms an internal shoulder at the base of the thread.

Plug 14, which may be molded in plastic, has an outer thread 30 complementary to thread 26, and the thickness of the plug is such that when threaded down into the cap member against rim 28 of the bottle, the upper surface 32 of the plug is substantially flush with rim 34 of the cap member. For security purposes, surface 32 should not project substantially above rim 34.

The upper surface 32 of the plug is provided with a pair of diametrically spaced cylindrical depressions 36 conforming to projections 38 on key 16 to enable the plug to be threaded out of and into the cap member to open and securely close the bottle by insertion of and suitable rotation of the key. The key, which may also be a plastic molding, may comprise a flat plate 40 with an opening 42 for mounting the key on a key chain 44, and the projections 38 being suitably formed on one side of the plate 40. The key may also have other projections, as shown, for use with different plugs, for example.

The above described structure is simple and economical to manufacture and, by suitable shaping of the cap member, can be applied to diverse forms of containers without having to make substantial modifications to the container.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A security cap structure for containers such as medicine bottles and the like having an opening defined by a container neck, the structure comprising a cap member having a skirt portion for gripping around the neck of the container and a hollow cylindrical portion with an internal thread for projection above the rim of the container, a threaded plug for threading into the cylindrical portion of the cap member to a position such that an outer surface of the plug does not project substantially above the rim of the cylindrical portion, at least one key-receiving depression in an outer surface of the plug, and a key having a projection related to the key-receiving depression in the plug, whereby threading of the plug out of the cylindrical portion of the cap member from said position is dependent upon use of the key.

2. The invention of claim 1 wherein the depth of the threads of the cap member related to the depth of the plug is such that with the plug fully threaded into the cap member, the outer surface of the plug does not project substantially from, and is preferably substantially flush with the rim of the cylindrical portion of the cap member.

3. The invention of claim 1 wherein the key comprises a flat rectangular plate with said projection formed on one longitudinal edge thereof, and the plate includes an opening adjacent one end for mounting the key on a key holder device.

4. The invention of claim 1 wherein said at least one depression comprises a pair of diametrically opposed openings in the outer surface of the plug, and the key comprises a rectangular plate having a pair of projections conforming to said openings on one edge of the plate.

5. A container such as a medicine bottle and the like having a neck with a rim defining an opening for the container, a substantially cylindrical member having an internal thread extending upwardly from the neck, with said rim defining an internal shoulder at the base of the thread, a cylindrical externally threaded plug for threading into the cylindrical member, the depth of the plug being such that when seated on said shoulder the outer surface of the plug does not project substantially above the rim of said cylindrical member, at least one key-receiving depression in the outer surface of the plug, and a key for threading the plug into and out of the cylindrical member, the key having a projection complementary to said depression.

6. The invention of claim 5 wherein the cylindrical member is formed on a cap which is secured to the neck of the container in a manner substantially precluding removal of the cap in normal usage of the container.

7. The invention of claim 5 wherein the plug has a pair of diametrically opposed key-receiving depressions in the upper surface, and the key comprises a flat plate with a pair of projections on one edge complementing said depressions in size and location.

8. In combination with a container, such as a medicine bottle, having a neck defining an opening for the container, a security cap structure comprising a cap member having a skirt portion gripping the neck of the container in a manner substantially precluding removal of the cap member in normal usage of the container, and a hollow internally threaded cylindrical portion extending upwardly from the skirt portion above the rim of the container neck, an externally threaded cylindrical plug for threading into the cylindrical portion of the cap member to a terminal position wherein the outer surface of the plug does not project substantially above the rim of the cap member, and at least one key-receiving recess in the outer surface of the plug for receipt therein of a projection on a key for removing the plug from the container by rotation of the key.

9. The invention of claim 8 wherein the rim of the container neck forms an internal shoulder at the base of the cylindrical portion of the cap member against which the plug seats in said terminal position.

10. The invention of claim 8 wherein the cap member is adhered to the neck of the container.

11. The invention of claim 8 wherein the cap member is shrunk onto the neck of the container.

12. The invention of claim 8 wherein the neck of the container has an external circumferential flange and the skirt portion of the cap member fits over said flange.

13. The invention of claim 8 including a key formed with a projection conforming to the recess in the outer surface of the plug for removing the plug from the cap.

* * * * *